US006070674A

United States Patent [19]

Williamson et al.

[11] Patent Number: 6,070,674

[45] Date of Patent: Jun. 6, 2000

[54] MODIFIED CAGE MEMBER FOR AN IMPACT MECHANISM

[75] Inventors: Paul Williamson, Ft. Mill; Paul Gerhart, Rock Hill, both of S.C.

[73] Assignee: Chicago Pneumatic Tool Company, Rock Hill, S.C.

[21] Appl. No.: 09/096,056

[22] Filed: Jun. 11, 1998

[51] Int. Cl.[7] ..... B25D 15/00

[52] U.S. Cl. ..... 173/1; 173/93; 173/93.5

[58] Field of Search ..... 173/93, 93.5, 93.6

[56] References Cited

U.S. PATENT DOCUMENTS

| | | | |
|---|---|---|---|
| 2,575,523 | 11/1951 | Mitchell . | |
| 3,144,108 | 8/1964 | Reynolds | 173/93.5 |
| 3,144,109 | 8/1964 | Alajouanine . | |
| 3,321,043 | 5/1967 | Vaughn | 173/93.5 |
| 3,661,217 | 5/1972 | Maurer . | |
| 3,848,680 | 11/1974 | Legler . | |
| 4,313,505 | 2/1982 | Silvern | 173/93.5 |
| 4,460,049 | 7/1984 | Shibata . | |
| 4,553,948 | 11/1985 | Tatsuno . | |
| 4,557,337 | 12/1985 | Shibata . | |
| 4,585,078 | 4/1986 | Alexandrov et al. . | |
| 4,609,089 | 9/1986 | Kobayashi et al. . | |
| 4,683,961 | 8/1987 | Schoeps . | |
| 4,735,595 | 4/1988 | Shoeps | 173/93 |
| 4,967,852 | 11/1990 | Tatsuno . | |
| 5,083,619 | 1/1992 | Giardino et al. . | |
| 5,435,398 | 7/1995 | Juan | 173/93.5 |
| 5,622,230 | 4/1997 | Giardino et al. . | |

*Primary Examiner*—Scott A. Smith
*Attorney, Agent, or Firm*—Schmeiser, Olsen & Watts

[57] ABSTRACT

An impact mechanism having a rotating cage member that supports at least one hammer for imparting impacts upon an anvil. More particularly the present invention relates to a cage member of an impact mechanism wherein each hammer pin is supported in a partial bore hole in the end of the cage member closest to the motor of the impact mechanism.

13 Claims, 3 Drawing Sheets

MODIFIED CAGE MEMBER FOR AN IMPACT MECHANISM

FIELD OF THE INVENTION

The present invention relates generally to impact mechanisms and, more particularly, to a pneumatic impact mechanism having a cage member with improved strength characteristics.

BACKGROUND OF THE INVENTION

Impact mechanisms such as pneumatic impact wrenches and the like are well known in the prior art. One such device is disclosed in U.S. Pat. No. 3,661,217 to Maurer, incorporated herein by reference. Such prior art impact mechanisms generally include a motor having an output shaft that rotates a cage member. The cage member journals a power output shaft or anvil at a bore of the cage member. The anvil includes either a single jaw or a pair of jaws depending on the number of hammers or dogs. Each hammer is pivotally coupled to the cage member on a longitudinal hammer pin such that the hammer pivots with respect to, and rotates with, the cage member. As the cage member rotates, hollow interiors of the hammers engage with the jaws to engage the anvil and to transmit an impact to the anvil.

In such prior art configurations, the end wall of the cage member nearest the motor will commonly crack and fail due to high impact stresses. The inventors have discovered that such damage is due in part to the use of support holes for the hammer pins which extend completely through the end wall of the cage member. The present invention provides a design improvement that overcomes the above-described disadvantages of the prior art.

SUMMARY OF THE INVENTION

In order to overcome the deficiencies of the prior art, the present invention provides a cage member for an impact mechanism having improved strength characteristics. Generally, the present invention provides an apparatus comprising:

a cage member for an impact mechanism, the cage member including at least one partial bore hole in an end thereof for supporting an end of a hammer pin.

The present invention additionally provides a cage member for an impact mechanism, comprising:

first and second end plates;

at least one partial bore hole in the first end plate;

at least one through bore hole in the second end plate; and first and second struts extending between the first and second end plates, at least one of the struts including a longitudinal groove that extends between the first and second end plates from one of the partial bore holes to one of the through bore holes.

The present invention further provides an improved impact mechanism comprising:

a motor;

a cage member connected to an output of the motor;

an anvil rotatably supported by the cage member;

at least one hammer positioned around the anvil to impart an impact on the anvil; and a pin pivotally coupling each hammer to the cage member;

wherein a first end of the cage member includes at least one partial bore hole for supporting an end of each pin.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
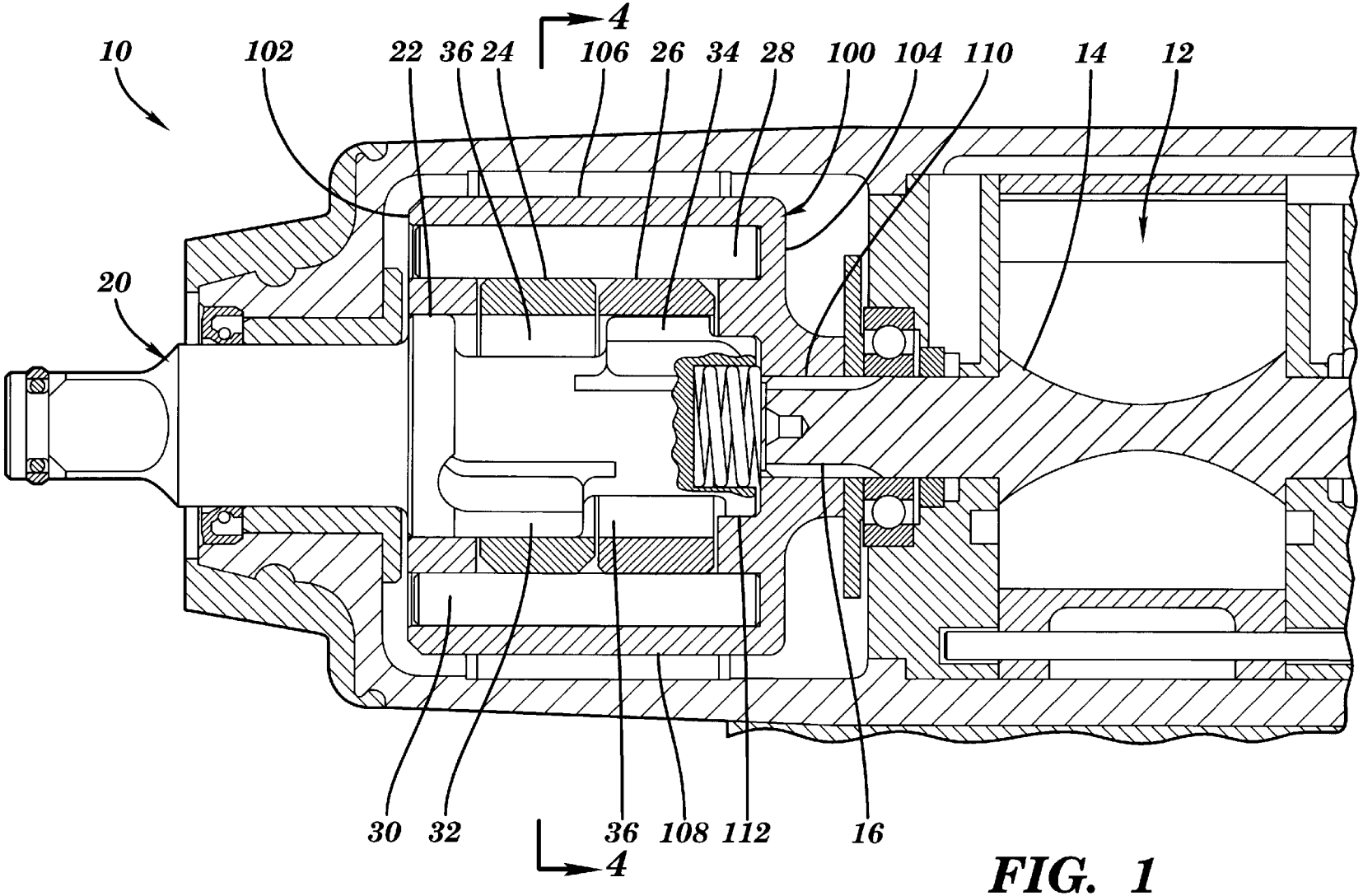
FIG. 1 is a side cut-away view of an impact mechanism incorporating a cage member in accordance with a preferred embodiment of the present invention.

The features and advantages of the present invention are illustrated in detail in the accompanying drawings, wherein like reference numerals refer to like elements throughout the drawings.

Referring to FIG. 1, there is illustrated a side cut-away view of an impact mechanism 10 incorporating a cage member 100 in accordance with a preferred embodiment of the present invention. The impact mechanism includes a motor 12 having an output shaft 14 with a splined end portion 16 configured to engage and rotate the cage member 100.

The cage member 100 is generally formed in the shape of a hollow carrier having an anvil end plate 102 and a spline end plate 104 joined by a pair of diametrically opposed struts 106 and 108. The spline end plate 104, located adjacent the motor 12, includes a corresponding splined connection 110 for engagement with the splined end portion 16 of the output shaft 14 of the motor 12.

Figure 4:
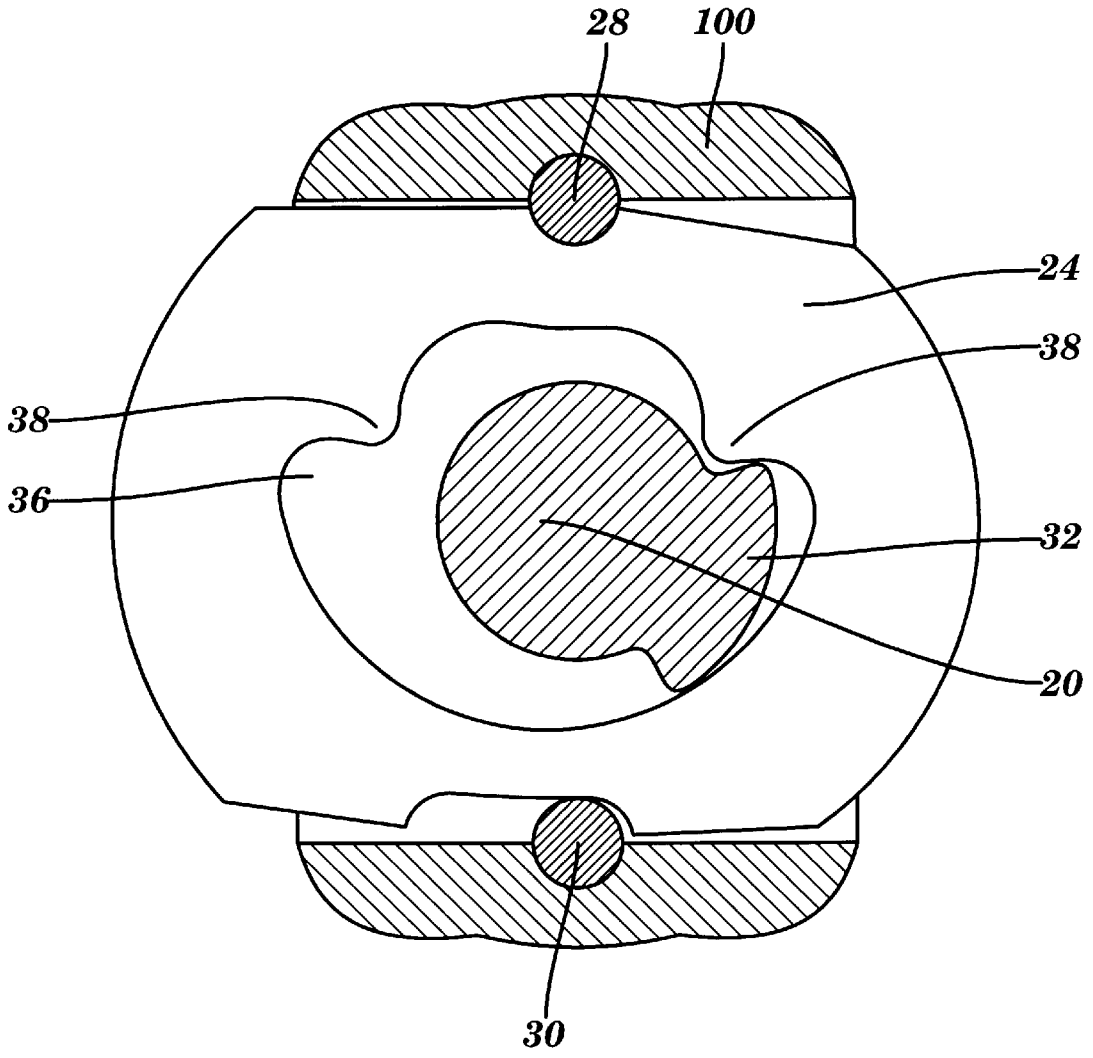
FIG. 4 is a cross-sectional view taken along line 4—4 of FIG. 1.

The cage member 100 journals a power output shaft or anvil 20 in a cage member bore 112 formed in the spline end plate 104 adjacent the splined connection 110. The cage member 110 itself is journaled on the anvil 20 at a location indicted by 22. Also, on the inner part of the cage member 100, the cage member 100 pivotally supports hammers or dogs 24, 26. As further illustrated in FIG. 4, the hammers 24, 26 are pivotally coupled to the cage member 100 by longitudinal hammer pins 28, 30 such that the hammers 24, 26 pivot with respect to, and rotate with, the cage member 100.

The anvil 20 includes a pair of jaws 32, 34 received within openings 36 of the hammers 24, 26, respectively. As the hammers 24, 26 accelerate in the rotary direction, the hammers 24, 26 are rocked back and forth by the rotation of the cage member 100 and the camming features of the openings 36. Each of the hammers 24, 26 includes a pair of impact surfaces 38, one for a forward direction and one for the reverse direction, to impart an impact on the jaws 32, 34 of the anvil 20. When the hammers 24, 26 strike the anvil jaws 32, 34, the hammers rock out of engagement, freeing the motor 12 to rotate one more turn to strike again.

Figure 2:
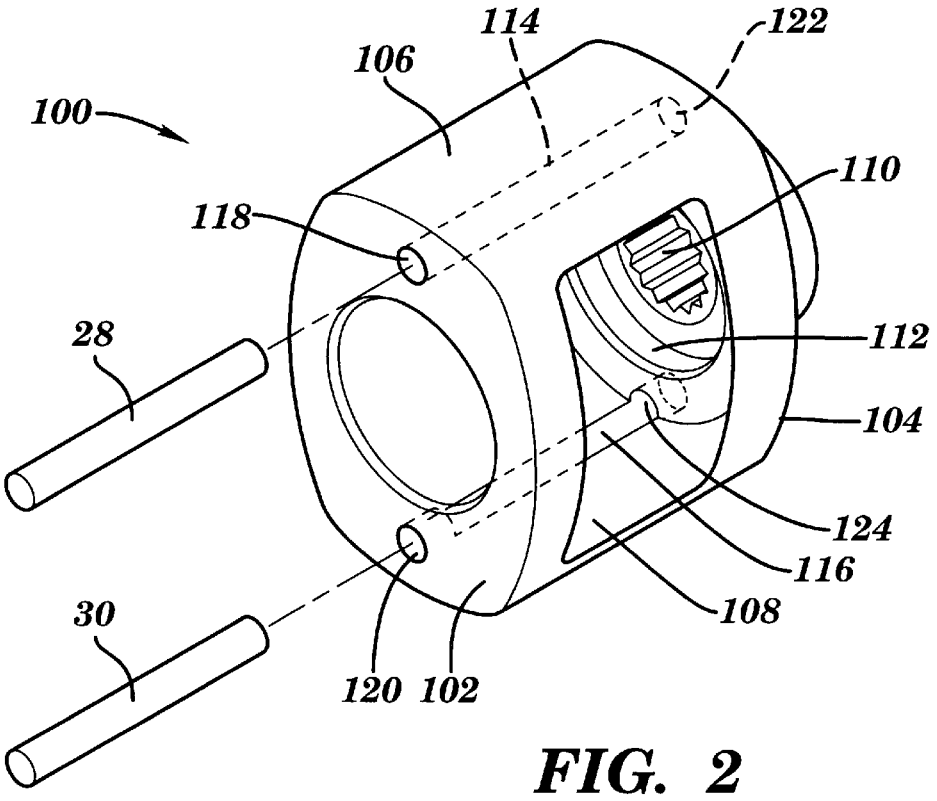
FIG. 2 is an exploded view of a cage member in accordance with the preferred embodiment of the present invention.
Figure 3:
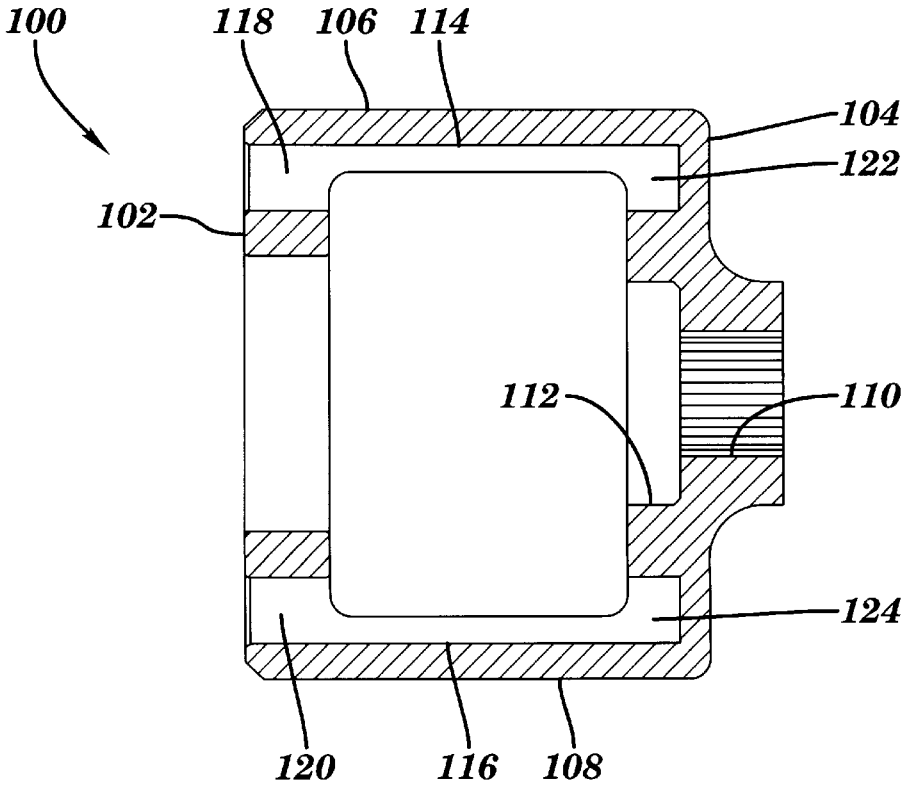
FIG. 3 is a cross-sectional side view of the cage member of FIG. 2.

The cage member 100 is illustrated in greater detail in FIGS. 2 and 3. FIG. 2 is an exploded view of the cage member 100 with the hammer pins 28, 30 removed. FIG. 3 is a cross-sectional side view of the cage member 100.

As detailed above, the hammers 24, 26 are pivotally coupled to the cage member 100 by longitudinal hammer pins 28, 30. The hammer pin 28 is received in a longitudinal groove 114 formed in the strut 106 of the cage member 100. Similarly, the hammer pin 30 is received in a longitudinal groove 116 formed in the opposing strut 108 of the cage member 100. The anvil end plate 102 of the cage member 100 is provided with first and second through bore holes 118, 120. The hammer pin 28 is inserted into the longitudinal groove 114 via the first through bore hole 118. Likewise, the hammer pin 30 is inserted into the longitudinal groove 116 through the second through bore hole 120. The through bore holes 118, 120 additionally serve to support a first end of the hammer pins 28, 30, respectively, when inserted into the cage member 100.

The spline end plate 104 is provided with first and second partial bore holes 122, 124. The first partial bore hole 122 is configured to receive and support a second end of the hammer pin 28. Similarly, the second partial bore hole 124 is configured to receive and support a second end of the hammer pin 30. When seated within the longitudinal grooves formed in the struts of the cage member 100, the hammer pins are coaxially aligned with a corresponding set of the through and partial bore holes formed in the anvil and spline end plates 102, 104, respectively, of the cage member 100.

As illustrated in cross-section in FIGS. 1 and 3, the partial bore holes 122, 124 do not extend through the spline end plate 104 of the cage member 100. Advantageously, the use of the partial bore holes 122, 124 eliminates the stress related failures associated with the use of through bore holes in the end wall nearest the motor of prior art cage members.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention as defined by the accompanying claims.

We claim:

1. An impact mechanism comprising;

a cage member;

an anvil rotatably supported by the cage member;

at least one hammer positioned around the anvil to impart an impact on the anvil;

a pin pivotally coupling each hammer to the cage member, wherein a first end of the cage member includes at least one partial bore hole for supporting an end of each pin, and wherein a second end of the cage member includes at least one through bore hole for supporting an opposing end of each pin;

first and second struts extending between the first and second ends of the cage member, wherein each of the struts includes a longitudinal groove for receiving one of the pins, each of the longitudinal grooves extending between one of the through bore holes and one of the partial bore holes.

2. The impact mechanism according to claim 1, wherein the anvil includes at least one jaw which receives impacts from the at least one hammer.

3. The impact mechanism according to claim 1, further comprising two hammers, wherein the anvil includes two jaws.

4. The impact mechanism according to claim 1, wherein the first end of the cage member further includes a connector for receiving an output of a motor, and wherein the cage member rotates upon rotation of the motor output.

5. An apparatus comprising:

a cage member for an impact mechanism, the cage member including at least one partial bore hole in a first end thereof for supporting an end of a hammer pin, and wherein a second end of the cage member includes at least one through bore hole for supporting an opposing end of each hammer pin; and first and second struts extending between the first and the second end of the cage member, wherein each of the struts includes a longitudinal groove for receiving one of the hammer pins therein, each of the longitudinal grooves extending between one of the partial bore holes in the first end of the cage member and one of the through bore holes in the second end of the cage member.

6. The apparatus according to claim 5, wherein the first end of the cage member is positioned adjacent to a motor of the impact mechanism.

7. The apparatus according to claim 5, wherein the first end of the cage member includes a connector for receiving an output of a motor of the impact mechanism.

8. The apparatus according to claim 5, wherein a second end of the cage member includes at least one through bore hole for supporting an opposing end of each hammer pin.

9. The apparatus according to claim 5, wherein the first end of the cage member further includes a bore for supporting an anvil of the impact mechanism.

10. The apparatus according to claim 9, wherein a second end of the cage member is configured to be journaled on the anvil of the impact mechanism.

11. A cage member for an impact mechanism, comprising:

first and second end plates;

at least one partial bore hole in the first end plate;

at least one through bore hole in the second end plate; and first and second struts extending between the first and second end plates, at least one of the struts including a longitudinal groove that extends between the first and second end plates from one of the partial bore holes to one of the through bore holes.

12. The cage member according to claim 11, further including a motor output connector in the first end plate.

13. A method for reducing stress failures in a cage member of an impact mechanism, the impact mechanism including an anvil rotatably supported by the cage member, at least one hammer positioned around the anvil to impart an impact on the anvil, and a hammer pin pivotally coupling each hammer to the cage member, including the steps of;

supporting a first end of each hammer pin in a partial bore hole formed in a first end of the cage member;

supporting a second end of each hammer pin in a through bore hole formed in a second end of the cage member; and supporting each hammer pin in a longitudinal groove in a strut extending from the partial bore hole to the through bore hole.

* * * * *